United States Patent [19]

Gunnarsson

[11] 4,110,864

[45] Sep. 5, 1978

[54] SWEEPER HOOD WITH TRANSVERSE AIR DUCT AND BROOM COMPARTMENTS

[75] Inventor: Arne Nils Gunnarsson, Upland, Calif.

[73] Assignee: FMC Corporation, San Jose, Calif.

[21] Appl. No.: 836,647

[22] Filed: Sep. 26, 1977

[51] Int. Cl.[2] ..... E01H 1/08

[52] U.S. Cl. ..... 15/340; 15/346; 15/383

[58] Field of Search ..... 15/340, 345, 346, 383

[56] References Cited

U.S. PATENT DOCUMENTS

| | | | |
|---|---|---|---|
| 514,678 | 2/1894 | Furnas | 15/346 |
| 2,913,744 | 11/1959 | Gregersen | 15/340 X |
| 3,189,932 | 6/1965 | Daneman | 15/340 |
| 3,605,170 | 9/1971 | Hank et al. | 15/340 X |
| 3,808,632 | 5/1974 | Aagesen | 15/340 |
| 4,044,422 | 8/1977 | Larsen | 15/340 |

FOREIGN PATENT DOCUMENTS

| | | | |
|---|---|---|---|
| 1,155,156 | 10/1963 | Fed. Rep. of Germany | 15/346 |

*Primary Examiner*—Christopher K. Moore

*Attorney, Agent, or Firm*—J. F. Verhoeven; C. E. Tripp

[57] ABSTRACT

A street sweeper hood has a transverse main compartment with an intermediate transverse partition that stops short of the swept surface and divides the main compartment into a front transverse air duct compartment and a rear broom compartment. Air and debris enter an inlet port at the curb end of the air duct and are withdrawn at the opposite end by a blower, the stream of air and entrained debris being accelerated along the air duct by an inclined top plate. A flexible scoop at the curb side of the inlet port and a windrower at the opposite side deflect debris into a tunnel that forms the inlet port.

11 Claims, 11 Drawing Figures

FIG_1
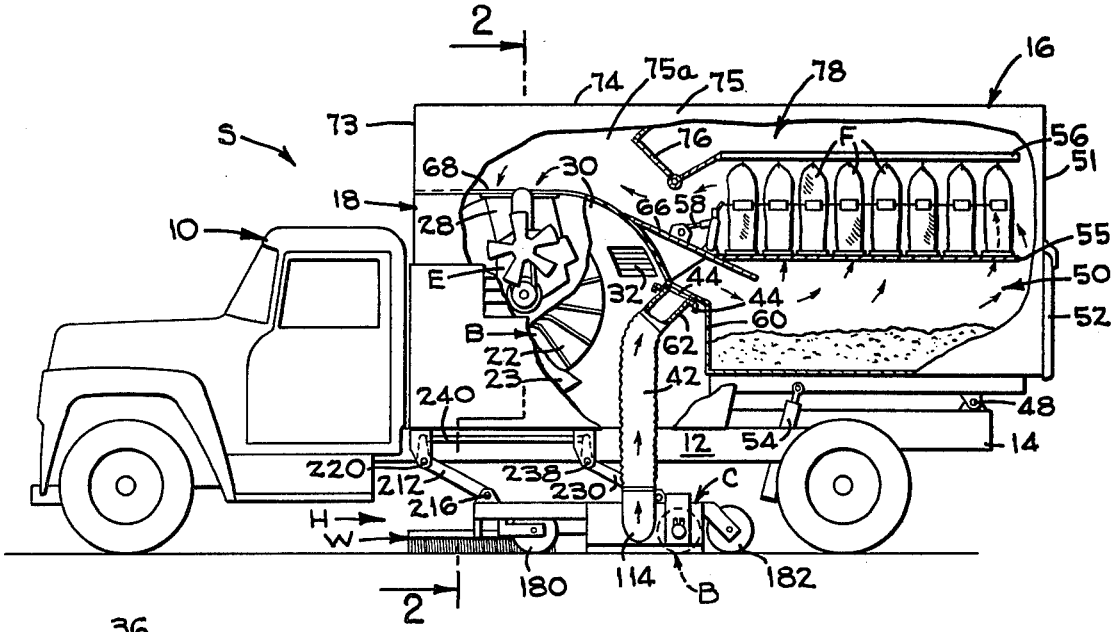
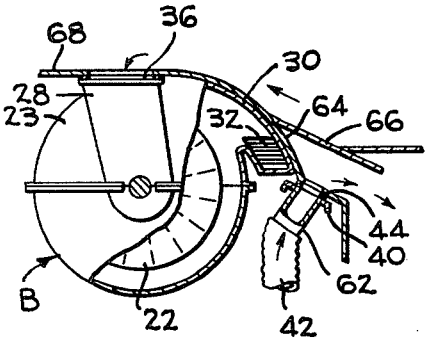
FIG_2A
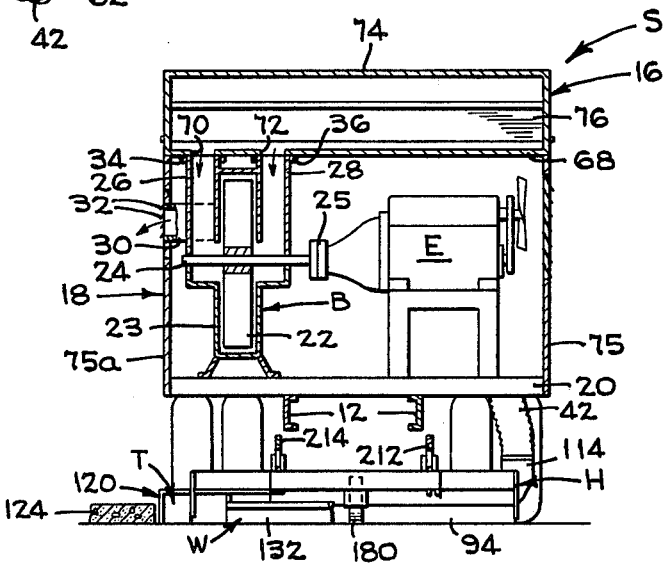
FIG_2

FIG_6
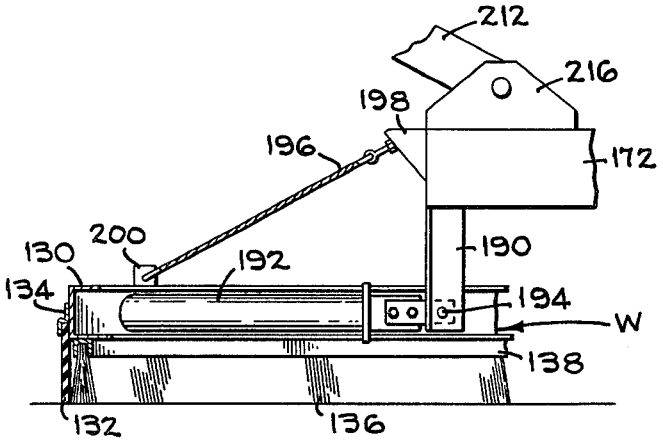
FIG_7
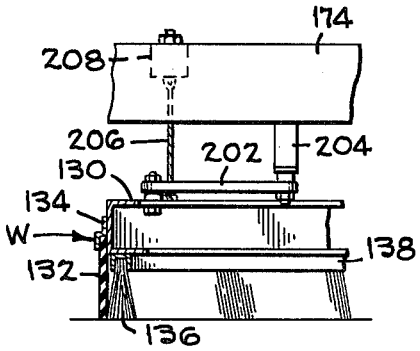
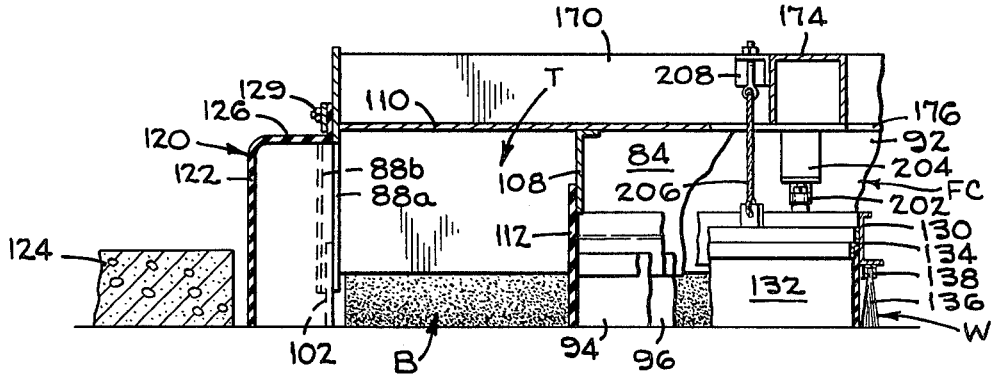
FIG_8
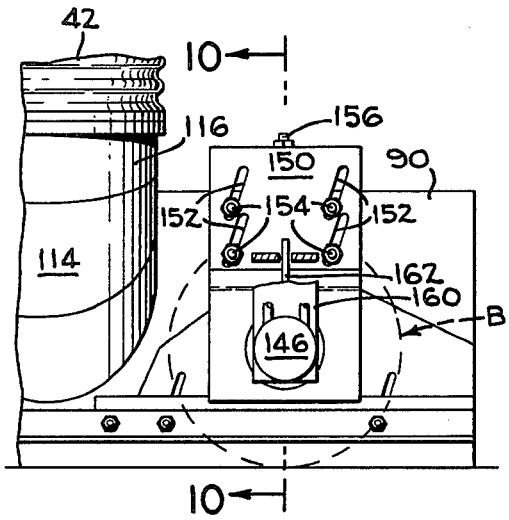
FIG_9
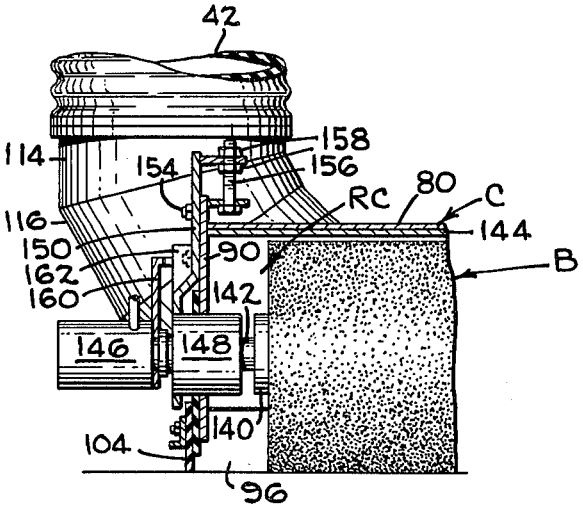
FIG_10

SWEEPER HOOD WITH TRANSVERSE AIR DUCT AND BROOM COMPARTMENTS

DESCRIPTION OF PRIOR ART

Prior sweepers can be generally classified as follows:

1. Open air circuit or vaccum systems.
   a. Pure vacuum systems
   b. Hybrid vacuum systems associated with a broom or brush
2. Air recirculation or closed air circuit systems.
   a. Pure air recirculation systems.
   b. Hybrid air recirculation systems associated with a broom or brush In an open air circuit or pure vacuum sweeper, air is drawn from the surface surrounding the hood and into the hood. Air is drawn from the hood to the hopper and through a filtering system by a blower and the air is discharged by the blower back to the atmosphere. Prior pure vacuum systems suffer from a major disadvantage in that the air enters the hood at numerous zones and must be accelerated from zero to maximum velocity at all of these zones as it enters the hood and passes through the system. Hence, the blower must accelerate the air at each entry zone from zero velocity to a velocity adequate to entrain the debris and the resultant kinetic energy imparted to each of the various streams of entering air during the aforesaid acceleration of the air dissipated when the blower discharges the air to the atmosphere. Another disadvantage of the pure vacuum system is that it does not provide effective sweeping of dirt adhering to the ground (caked dirt). This disadvantage is aggravated by the fact that the velocity of the boundary layer of air adjacent to the ground is inherently low. However, the pure vacuum system has the advantage that there is no puffing of dust from within the hood back to the surrounding atmosphere.

Some of the disadvantages of the pure vacuum system are corrected by a hybrid vacuum system wherein a broom is associated with the hood for dislodging caked dirt and for sweeping the dirt into the rising air stream which is being accelerated by the blower from the adjacent swept surface. Such hybrid systems have the advantage over the pure vacuum systems of more effective sweeping under difficult conditions, but insofar as energy requirements are concerned, they cannot make optimum use of the kinetic energy of the rising stream of accelerated air as a means for entraining particles. The potentially useful kinetic energy of the rising air stream is lost when the air is discharged from the blower and, of course, energy is required to drive the sweeper broom.

In air recirculation or closed air circuit systems, air from the hopper is returned to the hood by the blower instead of being exhausted to the atmosphere. This has the advantage of making it possible to reduce the energy requirements of the blower. However, most of such systems present dust puffing problems and all of them require not only an air seal between the hopper and the air outlet line from the hood, but also require a seal between the hopper and the air inlet or return line to the hood. The most effective air recirculation system known to applicant, insofar as utilization of the kinetic energy of the air stream is concerned, is the system disclosed in the application of Larsen et al., Ser. No. 821,670, filed Aug. 4, 1977, which is a continuation of Ser. No. 647,307, filed Feb. 5, 1976, both of which are assigned to the FMC Corporation. The effectiveness of the aforesaid system results from an improved hood construction. The hood has an unobstructed transverse air duct with an air inlet at one end and an air outlet at the other end. The hood is designed to gradually accelerate a stream of air flowing along the unobstructed duct and hence the kinetic energy of the progressively accelerated stream of air flowing along the entire length of the duct is available for picking up, entraining and delivering debris to the air outlet line of the hood. The velocity of the air is maximum at the air outlet line and hence its kinetic energy is maximum at the zone wherein debris is delivered to the air outlet line. However, and as mentioned, recirculation air systems have certain inconveniences, namely, as the rate of air flow increases, the difficulty of controlling "dusting" problems increases. Also, in the hopper, the percentage of light debris and small particles that settle out of the airstream, especially when the hopper is partially or fully loaded, is less than that present in a full vacuum system. Thus, a mixing process takes place in the hopper, agitating the debris, so that some of it re-enters the air stream and passes through the blower, thereby increasing the abrasive wear of the blower impeller. Furthermore, a simple recirculation or recycled air circuit hood has some of the limitations of the open air circuit or pure vacuum systems relative to the sweeping of solidified or caked dirt from the surface.

With these preliminary basic comments on the major sweeper classifications, the art deemed most relative by applicant to the present invention will be referred to briefly.

The German Schorling Pat. No. 1,957,740 shows a street sweeper of the hybrid vacuum type having a suction nozzle 12 (the construction of which is not clearly disclosed) mounted in front of what appears to be a cylindrical broom. No seals with the swept surface between the broom housing and the suction nozzle are disclosed and there is no description of a transverse air stream duct that is substantially unobstructed along its length having an air and debris inlet port at one end and a suction line connected to the other end.

The French Lebon Pat. No. 1,198,142 discloses a hybrid vacuum type pickup structure for a street sweeper wherein a sealing flap is at the front edge only. The pickup has a rotatable boom that throws debris toward the apertured bottom wall 8 of a suction chamber behind a front flap 9, for withdrawal of air and debris through a suction line 14 by a blower 13. There is no compartment sealed with a swept surface that includes a rear broom compartment and substantially unobstructed transverse front air duct compartment.

The U.S. Pat. to Gregerson U.S. Pat. No. 2,913,744, issued Nov. 24, 1959, discloses a hybrid vacuum type sweeping machine having a sweeping box 6 which is not sealed with the swept surface but has a front flap 33. The sweeping box includes rear cylindrical brushes 3 which fling debris to a rapidly rotating rotor 4 that elevates the debris into a suction duct 7 leading to a blower evacuated hopper. No front compartment providing an unobstructed transverse duct for an air stream ahead of a rear broom compartment in a sealed hood is disclosed.

German Hulufors Pat. No. 1,534,139, which has a British counterpart Pat. No. 1,097,640, discloses a hybrid vacuum type leaf sweeper having a rear broom 11 separated from a suction fan 6 by a partially depending partition. The suction fan throws debris into a suction duct 13. The hood is not sealed with a swept surface nor is there a transverse flow unobstructed air stream duct with an air inlet at one end and an air and debris outlet at the other end.

The German Streicher Pat. No. 1,989,446 discloses hybrid vacuum type pickup hood 7 having an angled transverse suction pit 5 at the rear corner of the hood and a cylindrical broom 11, the rotational direction of which is not disclosed, at the front of the hood. The suction pit 5 is at the same end of the hood that has an opening to receive debris from a curb brush 27. Thus, this device cannot utilize the kinetic energy of a transversely flowing air stream along a substantially unobstructed duct for receiving debris dislodged by a broom behind such a duct.

British Schorling Pat. No. 836,177 discloses a hybrid air recirculation and broom sweeper having a pickup hood (FIGS. 8–10) with four suction lines 38 along the front side thereof and two air return lines 37 along the rear side thereof. The four suction lines will cause transverse air flow in opposite directions and hence will create stagnation points between their zones of connection to the hood. Furthermore, there is no transverse unobstructed air channel in front of the broom 4 for utilizing the kinetic energy of a transverse air stream for picking up debris dislodged by the broom, because there is a longitudinal air flow from inlet lines 37 to suction lines 38.

Italian Pat. No. 588,799 discloses a closed circuit or air return type debris pickup structure wherein a blower A blows air into a front transverse duct C and the direction of air flow is changed 90° again and flows along a transverse collector chamber L for delivery to a cyclone N. A separate nozzle R also receives air from the blower A and discharges at the end of the transverse collector chamber L. The change of direction and air flowing through the nozzle F into the collector L will facilitate dropout of debris.

The French Nave Pat. No. 400,532 discloses a hybrid air return broom type sweeper having a broom *b* flanked by a rear air blower nozzle *i* and a front suction nozzle *c*, the latter having a hinged flap *c'*. There is no enclosure sealed with the swept surface and this device will blow air and dust into the atmosphere creating dust problems. No transverse unobstructed air stream duct is disclosed.

The Canadian Krier Pat. No. 757,297 discloses a hybrid vacuum and broom type street sweeper having a chamber 22, that closely fits a brush 100 and is exhausted into the hopper at its upper side. The chamber is sealed with the swept surface by front and rear flaps 50,92 and by side flaps 90,91 but these are elevated above the surface, page 17, paragraph 1. Thus, air enters from both ends of the brush chamber and no transverse, unobstructed kinetic energy air stream duct is provided.

German Schorling Pat. No. 6922198 discloses a hybrid vacuum and broom type street sweeper having an air guiding hood 21 that has a rear compartment for a sweeping roller 20. The hood has a suction channel with a substantially central hose connection 31 (FIG. 2) and air can flow into the suction channel from unobstructed front and sides of the suction hood because there are no seals to restrict such flow. Also, since the suction connection is at the center of the channel there is no transverse duct for providing a unidirectional air stream that can develop sufficient kinetic energy for efficiently picking up debris dislodged by the broom 20.

British Wirsing Pat. No. 28,282, Dec. 5, 1910, discloses a hybrid air recirculation and broom type street sweeper having a suction nozzle *g* with a broom *k* at the front side of the nozzle. The front and sides of the nozzle are not sealed with the swept surface and the suction pipe *i* (FIG. 2) is connected to a mid portion of the suction nozzle so that air flows into the suction nozzle *g* from both ends and from the front, creating stagnation points near the center of the nozzle. Also, a compressed air nozzle L is provided which will blow out dust and which precludes the establishment of a transverse unidirectional kinetic energy air stream disposed in a compartment in front of the broom.

The U.S. Pat. to Sims No. 1,560,612, issued Nov. 10, 1925, discloses a vacuum sweeper having angled brushes 51,52 for windrowing debris to a small suction nozzle 29–31. No sealed hood is provided and there is no transverse air duct disposed in front of a debris dislodging broom or agitator.

As mentioned, a transverse unobstructed duct pickup hood of the air recirculation type having the outlet of a blower connected to an inlet duct at one end and an air return line connected to the other end of the duct and to an evacuated hopper with means for windrowing objects into a gradually accelerated air stream flowing along the duct, has been employed by the sweeper division of the FMC Corporation, assignee of the present application. The aforesaid pickup hood did not employ a broom or agitator behind the air stream duct and separated therefrom by a partition stopping short of the swept surface. The hood construction for gradually accelerating the air stream along an unobstructed transverse air duct for optimum utilization of kinetic energy imparted to the air stream by the blower forms the subject matter of the aforesaid continuation application of Larsen and Hiszpanski, Ser. No. 821,670, filed Aug. 4, 1977, which is a continuation of Larsen et al. Ser. No. 647,307, filed Feb. 5, 1976 (now abandoned), both applications being assigned to the FMC Corporation.

Other patents of which applicant is aware, but which are believed to be less pertinent than those previously mentioned are as follows:

| | | |
|---|---|---|
| Dunn | 1,356,272 | Oct. 19, 1920 |
| Hoffer et al | 1,269,106 | Feb. 22, 1921 |
| Cooper | 1,745,355 | Feb. 4, 1930 |
| Daneman | 3,189,932 | June 22, 1965 |
| Hank et al | 3,605,170 | Sept. 20, 1921 |
| French patent | 1,157,138 | May 27, 1958 |
| French patent | 1,073,516 | Sept. 27, 1954 |
| French patent | 1,184,015 | July 16, 1959 |
| German patent | 1,092,498 | Nov. 10, 1960 |
| German patent | 1,096,941 | Jan. 12, 1961 |

SUMMARY OF THE INVENTION

The pickup hood of the present invention is employed in a hybrid open air circuit or vacuum system. It has the advantage of a vacuum type sweeper in that it does not puff out dust. However, the sweeper does not waste the kinetic energy of the accelerated air stream, as in the case of most prior vacuum sweepers. The hood of the present invention has the energy saving advantages of the transverse duct air recirculation hood of the aforesaid Larsen et al. application, wherein the kinetic energy of an air stream that is gradually accelerated along the length of the duct is utilized to entrain particles of dust and carry them into the outlet line of the duct at one end thereof and on to an evacuated hopper. The sweeper of the present invention also has the advantages of sweepers employing a cylindrical broom which mechanically dislodges caked dirt from the swept surface but unless they are large and adequately powered, in prior sweepers such as brooms are not themselves an efficient dust conveyor unless they are associated with a high vacuum hood, wherein air enters the hood from a multiplicity of zones and is accelerated from zero to maximum velocity at each zone.

The pickup hood of the present invention, in one simple structure incorporates the desirable non-puffing features of pure vacuum systems, the energy saving advantage of the aforesaid Larsen et al. air recirculation system and the advantage of a broom or agitating brush for dislodging caked dirt, which agitator has a relatively low power requirement.

In accordance with the present invention, the pickup hood is formed as a transverse elongate main compartment sealed at the front and rear sides and at its ends with the hood providing parallel front and rear compartments. The front compartment comprises a transverse air stream duct that is substantially unobstructed along its length and has an air and debris inlet port at one end (preferably the curb end) of the duct and an air outlet or suction line connected to the other end of the duct for creating a uni-directional flow air stream along the length of the duct. The air duct is substantially unobstructed and along its length and its construction gradually accelerates air entering the inlet port so that the uni-directional air stream has imparted thereto a substantial amount of kinetic energy, which increases along the duct, for entraining debris particles and delivering them to the air outlet or suction line.

The parallel rear compartment of the hood contains a rotating cylindrical agitator, broom or brush that extends the full length of the hood and is co-extensive with the air duct and the portion thereof that provides the air inlet opening. The agitator or broom dislodges material adhering to the swept surface and throws it forwardly and somewhat upwardly beneath a depending partition between the compartments, which stops short of the swept surface. Debris dislodged by the broom is thereby flung into the uni-directional air stream flowing along the unobstructed length of the front compartment air duct. With this hood construction, the blower imparts kinetic energy to the air stream to enable it to dislodge debris from the swept surface and to entrain debris from the broom, but the hood is economical in its energy consumption by the blower because the blower need not accelerate air from zero velocity at numerous zones of entry, but need only the air from zero velocity at the single air inlet opening. Thus, energy supplied to the blower gradually increases the kinetic energy of a single air stream, enabling the uni-directional air stream to entrain material dislodged and flung into the air stream by the broom. Thus, the hood of the present invention has the advantages of a non-puffing vacuum type hood, of utilizing the kinetic energy of a uni-directional transverse air stream and the advantages of a broom in dislodging material adhering to the swept surface.

In the preferred embodiment of the invention, no gutter broom is necessary. The air inlet end of the transverse air duct forming the front compartment opens forwardly and is provided with a short flexible inlet scoop, the side wall of which diverges from the associated end wall of the hood. This forms a combined debris scoop and air accelerating nozzle which directs debris adjacent the curb into a stream of air flowing into the air inlet opening.

The opposite side of the air inlet opening is provided with a deflector or windrower which deflects loose material disposed in front of the hood into the stream of air entering the air inlet opening. This combination of a flexible inlet scoop at the curb side of the air inlet opening and the windrowing deflector obviates the need for the more expensive and energy utilizing curb brush that is usually required for effective cleaning at the curb end of the hood. Preferably, the air inlet opening to the transverse air duct is formed by forwardly projecting tunnel walls from which the scoop and the windrower diverge. This improves the air accelerating nozzle effect at the air inlet to the air duct. The flexibility of the scoop accommodates slight steering errors by the sweeper operator which bring the hood too close to a curb. The scoop merely flexes and its outer edge scrapes along the curb under these conditions.

Another feature of the present invention is that the air outlet or return line which delivers air and debris to the evacuated hopper is formed as a curved elbow which provides a smooth transitional change in the direction of the air as it leaves the transverse air duct provided by the front compartment unobstructed along its length.

The combination of a uni-directional air stream having substantial kinetic energy in a front compartment and a broom in the rear compartment results in a construction wherein the broom itself can be of smaller diameter and requires less energy for rotation than that usually employed in sweepers employing main cylindrical brooms in vacuum systems.

BRIEF DESCRIPTION OF THE DRAWINGS

FIG. 1 is a side elevation of a sweeper embodying the invention, with parts broken away.

FIG. 2 is a vertical section taken on line 2 — 2 of FIG. 1.

FIG. 2A is a fragmentary enlarged view of the blower.

FIG. 6 is a partial side elevation taken on line 6 — 6 of FIG. 3.

FIG. 7 is a partial elevation taken on line 7 — 7 of FIG. 3.

FIG. 8 is a partial front view of the hood taken on line 8 — 8 of FIG. 3.

FIG. 9 is an end view of the brush mounting structure looking along line 9 — 9 of FIG. 3.

FIG. 10 is a section through the brush mounting structure taken on line 10 — 10 of FIG. 9.

GENERAL DESCRIPTION OF THE SWEEPER

Figure 3:
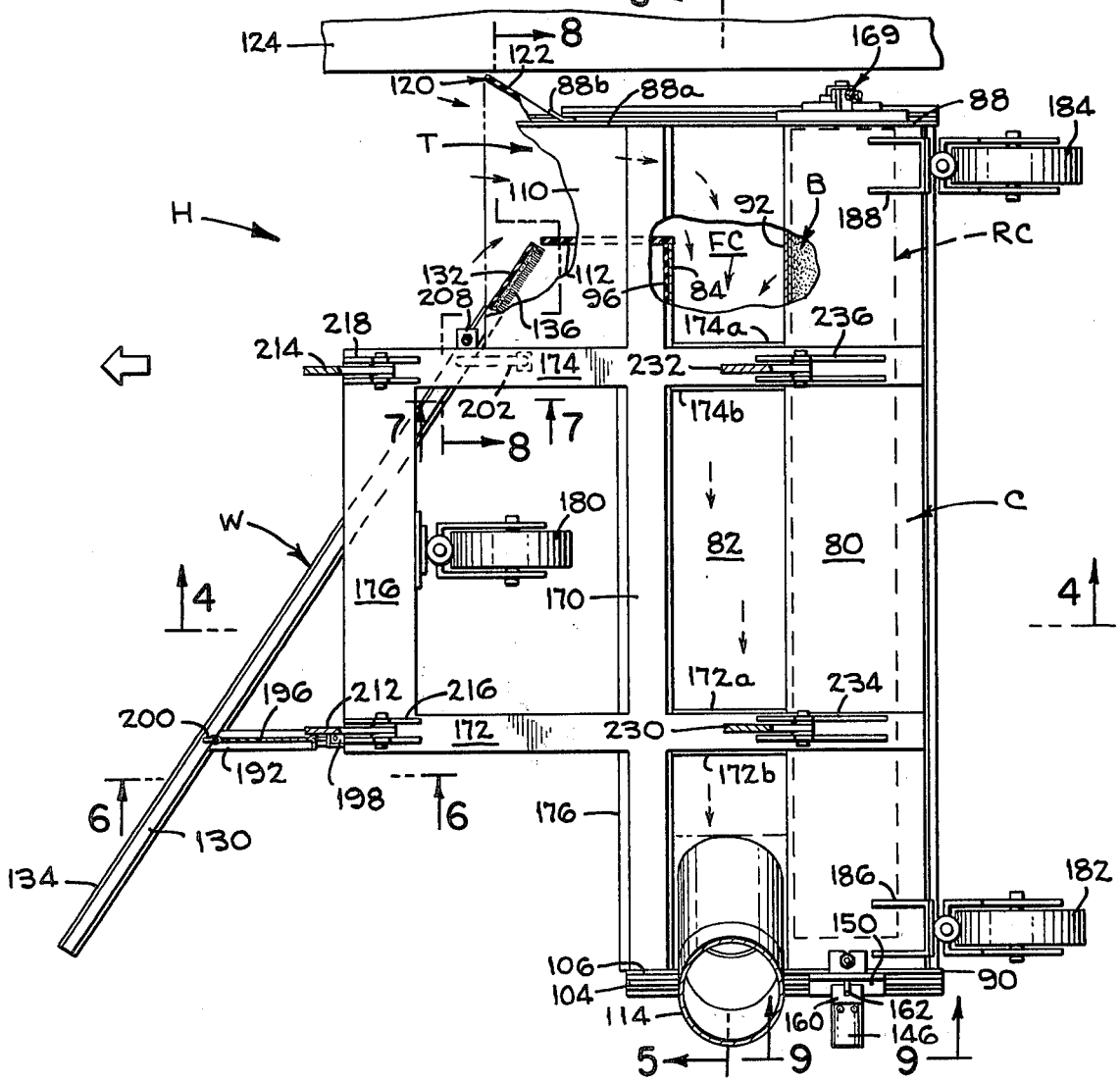
FIG. 3 is a plan view of the pickup hood with parts broken away.

A sweeper employing the hood of the present invention is illustrated in diagrammatic and simplified form in FIGS. 1, 2 and 2A, it being understood that the hood of the present invention can be employed as a pickup device for other sweeper configurations not specifically illustrated herein.

The sweeper S, in the embodiment shown is mounted on a modified truck chassis 10, having the usual wheeled chassis including main frame channels 12 and rear frame extensions 14 (FIG. 1). Mounted on the chassis is a pivoted hopper indicated generally at 16 and a fixed housing and frame work assembly 18. The housing 18 mounts a transversely disposed prime mover, such as an internal combustion engine E, by means of floor structure or framework 20 (FIG. 2). Also mounted in the housing 18, is a centrifugal blower B having an impeller 22 in a housing 23. The impeller is driven by a shaft 24 and a conventional, manually controlled clutch 25 from the engine E. The blower housing has left and right inlet ducts 26, 28 (FIG. 2). The blower housing has an outlet duct 30 (FIGS. 2 and 2A) which exhausts air through louvres 32 formed in an aperature in the left side wall of the chamber 18. The inlet ducts 26,28 are provided with seals 34,36 (FIG. 2A), for cooperating with air discharge openings formed in a front horizontal hopper wall.

Extending across the chamber 18 is a fixed flange 40 (FIGS. 1 and 2A) which mounts the upper end of an air and debris suction tube 42 connected (as will be described presently in detail) to one end of a duct of the hood H forming the subject matter of the present invention. The upper end of the suction tube 42 is provided with a seal 44 for cooperation with the hopper, as will be described.

The Hopper

The hopper 16, is formed as a normally closed box-like chamber, the rear end of which is pivoted at 48 to the rear frame extensions 14 of the chassis. The lower part of the hopper has a box-like debris receiving chamber 50, the rear wall 51 of which is closed by a door 52 that is normally locked in a closed position but which can be selectively opened, by means not critical to the present invention, when the hopper is elevated for dumping the debris. The hopper can be so elevated by a pair of piston and cylinder assemblies 54 connected to the chassis and to the hopper as shown in FIG. 1. Details for the controls of these cylinders is not critical to the present invention and are not shown. The upper portion of the debris chamber 50 is bounded by an apertured plate 55, the apertures of which are sealed with the lower end of a plurality of rows of filter bags F, each row of bags being suspended from a longitudinal bar 56 on an associated roof wall. The bags can be periodically shaken to dislodge fine debris therefrom by conventional shaking mechanism 58. The front end of the dirt debris chamber 50 is closed by a vertical wall 60 which connects to an inlet duct 62. The wall 60 has a continuation 64 that merges with a debris deflecting plate 66. The duct 62, which forms an inlet duct to the debris chamber, makes a releasable sealing engagement with the seal 44 for the hood outlet pipe 42 previously referred to (FIG. 2A).

The front walls 64,66 of the hopper merge with a horizontal, forwardly projecting wall 68 which is formed with apertures 70,72 (FIG. 2) for providing inlet openings to the blower inlet ducts 26,28, previously described. The seals 34,36 for the blower ducts make a sealing connection about the hopper openings 70,72 just mentioned. The hopper has a front wall 73 (FIG. 1), a roof 74, side walls 75,75*a* (FIG. 2) and the rear wall 51.

In operation, the blower B draws air through its inlet ducts 26,28, through the hopper openings 70,72 and through the porous walls of the filter F. Air is drawn into the lower, open ends of the filters F through the apertures in the filter plate 55, such air being drawn into the debris chamber 50 via the hopper tube 62 and the suction tube 42 from the hood. The heavier particles of debris settle out into the debris chamber 50 whereas the lighter particles and fine dust are filtered out by the filters F. These filters are periodically cleaned by the shaking mechanism 58 to loosen accumulations of dust on the filter bags, so that the dust will drop through the apertures in plate 55 and into the debris chamber. Filtered air entering the blower is exhausted to the atmosphere through the outlet duct 30, previously described, and the louvres 32 formed in the left side wall of the chamber 18.

As seen in FIG. 1, a door 76 is provided which can be shifted from the position shown, wherein the blower draws air through the filters, to a lowered position (not shown) wherein it seals with the debris deflecting wall 66 previously mentioned. This mode of operation is used under wet sweeping conditions, when it is not desired to introduce wet debris into the filters F, and under these conditions air drawn into the debris chamber 50 by the blower by-passes the filters and passes through an upper chamber 78 above the filters and through the opening provided by the lowered door 76.

Details of the blower and hopper construction just described are not critical to the present invention. Other constructions can be employed in connection with the hood H forming the subject matter of the present invention. The blower and hopper construction just described was incorporated in the Model 707 sweeper manufactured and sold by the Sweeper Division of the FMC Corporation in Pomona, CA. However, the hood H of the present invention was not employed in the aforesaid Model 707 sweeper.

Hood Construction

Details of the hood construction appear in FIGS. 3 – 10. The hood is formed with a main compartment indicated generally at C having top wall portions 80, 82, a front wall 84 and a rear wall 86. The main compartment also has an end wall 88 (adjacent the curb in the construction shown) and an opposite end wall 90. The main compartment C is formed with a depending partition 92 which stops short of the swept surface and divides the main compartment into elongate parallel front (forward) and rear transverse compartments FC, RC, respectively.

The main compartment, except at an air and debris inlet duct to the front compartment FC, is sealed with the swept surface. For example, the front wall 84 (FIG. 4) is sealed by means of flexible flaps 94,96 detachably secured to spaced elements of the front wall, in a manner known in the art. The rear wall 86 is similarly sealed with swept surface by flaps 98, 100. The right end or curb side end wall of the main compartment C is sealed by a flexible flap 102 (FIGS. 3, 5 and 8). The opposite or left end wall 90 is sealed with the swept surface by flaps 104,106 (FIGS. 3 and 5).

In order to admit air and entrained debris to the transverse air duct forming the front chamber FC, the right end wall 88 has an extension 88*a* forming one side of a tunnel-like inlet duct (FIGS. 3, 5 and 8) and indicated generally at T. The opposite side of the inlet duct T is formed by a metal side wall portion 108 depending from a top plate 110 of the tunnel, (FIG. 8). The side wall 108 mounts a depending flap 112 for sealing with the swept surface.

As seen in FIG. 5, the top wall 82 for the front chamber FC is inclined downwardly from the inlet tunnel T to the chamber outlet or suction duct 42. This duct, which has a flexible tubing section, connects to an outlet elbow 114 which opens into the top wall 82 of the front chamber at 115 (FIG. 5). The downward inclination of the top wall 82 of the front chamber gradually and progressively accelerates the air stream entering the inlet tunnel T as the air stream flows from the tunnel towards the elbow 114, so that the kinetic energy of the air stream gradually increases as it flows along the duct-like chamber FC. The curved outer wall portion 116 of the elbow 114 facilitates a smooth transition of the accelerated air stream from the hood into the suction line 42 leading to the hopper.

In order to serve the function of a curb brush and assist in accelerating the air stream entering the inlet duct or tunnel T of the hood, a scoop 120 is provided at the curb side of the hood, which is the right side in the embodiment illustrated. In the preferred embodiment, scoop 120 is made of flexible material, such as rubber reinforced fabric and has a side wall 122 which projects forwardly and laterally from the upstream edge of the end wall extension 88*a* (FIG. 3) forming an inlet duct bounding the inlet duct or tunnel T. The sweeper is operated so that the forward edge of the scoop side wall 122 is adjacent to or scrapes along the curb 124, as best seen in FIGS. 3 and 5. The scoop 120, in the form shown, is a one-piece unit having a flexible top wall 126 integral with the flexible side wall 122. As shown in FIG. 8, the top wall 126 is flanged and is secured to the end wall extension 88*a* of the hood by a clamp bolt and metal strip assembly 129. The rear vertical edge of the side wall 122 of the scoop 120 is restrained by an angled plate 88*b* at the upstream edge of the extension 88*a* of the hood end plate 88. Thus, air drawn into the tunnel T can flow through the scoop 120 and is accelerated as it enters the tunnel by the angled side wall 122 of the scoop.

In order to windrow debris into the tunnel T from in front of the hood, a windrower or deflector W is provided which projects forwardly and laterally from the downstream edge of the flap 112, the outer end of which defines the entrance to the tunnel T at the side of the tunnel opposite that mounting the scoop 120, as best seen in FIG. 3.

The construction of the windrower is best seen in FIGS. 6, 7 and 8. It comprises an elongate C-shaped channel 130 which mounts an outer flexible flap 132, preferably formed of rubberized fabric and clamped to the channel 130 by a clamp strip 134. To back up the flap 132, a brush 136 is provided which is secured in a channel strip 138 in a conventional manner, the channel strip 138 being mounted on the lower flange of the C-shaped channel 130, previously described.

Rotary Brush

Figure 4:
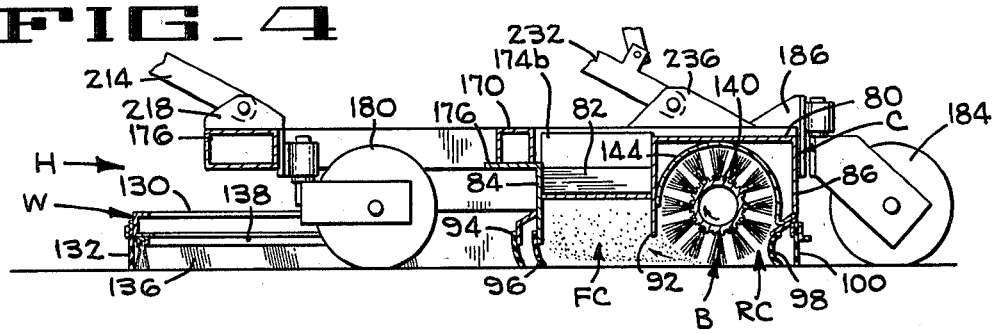
FIG. 4 is a transverse section through the hood taken on line 4 — 4 of FIG. 3.
Figure 5:
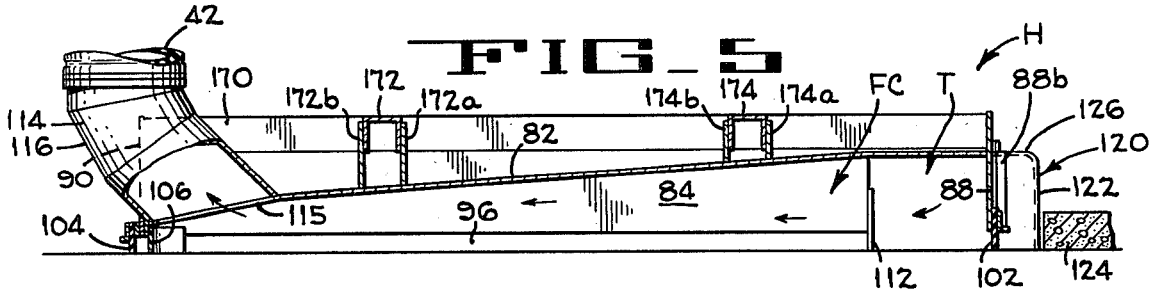
FIG. 5 is a longitudinal section through the air duct of the hood taken on line 5 — 5 of FIG. 3.

In order to loosen caked dirt from the swept surface and fling it slightly upwardly into the transversely accelerated stream of air in the front compartment FC, a rotating brush or broom B is provided in the rear compartment RC, as best seen in FIGS. 4 and 10. The broom B has a tubular hub 140 which terminates at one end in a drive shaft 142 (FIG. 10), and a similar idling shaft (not shown) is provided at the other end. The hub 140 has a conventional array of bristles forming a generally cylindrical brushing surface. When new, the broom closely fits a semi-cylindrical shroud 144 in the rear compartment RC, as seen in FIG. 4. As seen in FIG. 10, the broom shaft 142 is driven by a hydraulic motor 146 from the hydraulic system of the sweeper (not shown). The shaft of the hydraulic motor is mounted in a bearing assembly 148 which is secured to a mounting plate 150 that is adjustably mounted on the associated end wall 90 of the hood. The portion of the end wall 90 at the bearing assembly 148 is slotted to receive the bearing assembly.

As seen in FIG. 9, the motor and bearing mounting plate 150 are adjustably mounted on the end wall 90 to accommodate for broom wear. The details of this construction are not critical to the present invention and a similar construction has been employed in the aforesaid FMC model 707 sweeper. In the construction shown, four diagonal slots 152 are provided in plate 150 and the plate can be clamped in its adjusted position on the end wall 90 by clamp bolts 154. When the bolts are loosened, the vertical position of the mounting plate 152 can be adjusted and locked by an adjusting stud 156 which projects upwardly from a bracket secured to the end wall 90 and which is threaded to receive adjusting lock nuts 158 (FIG. 10). In order to absorb the driving torque of the broom motor 146, the housing of the motor is provided with a torque arm 160 which has an inwardly projecting flange that is notched to receive a torque finger 162, as seen in FIGS. 3 and 9. The idling end of the broom is similarly mounted so that it can be adjusted to follow the adjustment of the driven end. The adjustable mounting structure for the idling end of the broom is indicated at 169 in FIG. 3 but the details thereof are not described because such adjustments are known in the art and their details are not critical to the present invention. Suffice to say that the idler shaft of the broom is mounted in a clamp plate that can be loosened to follow the adjustment of the driven end and that a lock screw assembly is provided to hold the clamp plate in its finally adjusted position. The angle slots 152 (FIG. 9) are disposed so that as the broom is adjusted to accommodate for wear of its bristles, the front portion of the broom remains close to the partition 92 (FIG. 4) which separates the rear compartment RC from the front compartment FC of the hood.

Hood Framework

A framework structure is provided to stiffen the hood, to facilitate mounting of the hood on the sweeper and to support the windrower or deflector W. The frame work structure also mounts hood supporting caster wheels. The frame work includes a front laterally extending or transverse channel 170 (FIGS. 3–5 and 8) integral with longitudinally disposed channels 172,174. As seen in FIG. 4, the transverse channel 170 is welded to a plate 176 which projects from the front wall 84 of the front chamber FC of the hood.

As seen in FIGS. 3 and 5, the longitudinal channels 172,174 also mount vertical plates 172*a*,172*b* and 174*a*, 174*b* which are connected to the slanting top wall 82 of the front air duct chamber FC. The front ends of the longitudinal channels 172,174 are connected by a box-like transverse cross piece 176. A front caster wheel 180 (FIGS. 3 and 4) is pivotally supported on the cross piece 176 and rear caster wheels 182,184 are pivotally supported on brackets 186,188 secured to the top wall 80 of the rear chamber RC of the main compartment C.

Windrower Support

The windrower or deflector W is suspended from the longitudinal frame pieces 172,174. As seen in FIG. 6, the left longitudinal frame member 172 has a depending bracket 190. The C-shaped channel 130 of the windrower W is integrally connected to a longitudinal left arm 192 (also see FIG. 3) which is pivoted to the bracket 190 at 194. To adjustably determine the force exerted by the flap 132 and the brush 136 of the windrower on the swept surface, an adjustable length of flexible cable 196 (FIG. 6) is connected between a bracket 198 on the hood frame structure and an ear 200 on the channel 130.

Similarly, and as seen in FIGS. 3, 7 and 8, a portion of the windrower and deflector near the tunnel T is suspended and positioned by a link 202 extending from the channel 130 to a post 204 depending from the frame member 174. This portion of the windrower is suspended by a vertically positioned cable 206 that adjustably supports the channel 130 from a bracket 208 on the longitudinal frame member 174. The connections for the cable 206 are best seen in FIG. 8.

Hood Mounting

The hood H is mounted on the sweeper S by a hydraulically operable trailing link construction which is well known in the art and which is employed on the aforesaid FMC model 707. Hence, this mounting structure will only be mentioned briefly. The front portion of the hood is supported on the sweeper chassis by front links 212,214. The lower ends of both of these links appear in FIG. 3 and the left link 212 appears in FIG. 1. The lower ends of the links 212,214 are pivotally mounted in hood frame ears 216,218, both of which appear in FIG. 3 and one of which appears in FIGS. 1, 4 and 6. The upper end of the links 212,214 are pivoted to the chassis, such as at the pivot 220 for the link 212 shown in FIG. 1.

The rear portion of the hood H is supported by trailing links 230,232, the lower ends of both appearing in FIG. 3. The left rear link 230 appears in FIG. 1 and the right rear link 232 appears in FIG. 4. The lower end of the rear links are mounted in ears 234,236 (FIG. 3) on the hood frame work in the manner of the front links 214,216 and the upper ends of the rear links 230,232 are pivotally mounted on the chassis as indicated at 238 in FIG. 1. The hood can be hydraulically raised and lowered by hydraulic cylinders and linkage mechanism known in the art and not illustrated in detail. A portion of this mechanism includes cross bar links 240, one of which appears in FIG. 1. The hydraulic cylinders and actuating mechanism for raising the hood for transport and for lowering it for sweeping are not shown, such features being well known in the art, as exemplified by the aforesaid FMC Model 707 sweeper.

Operation

In operation, the hydraulic controls for the sweeper head H (not shown) are operated to lower the sweeper head caster wheels to the ground as shown in FIG. 1. The windrower W will have been adjusted to apply the selected pressure on the swept surface. Also, the engine E for the blower will be running and if a clutch 25 is provided, this clutch is engaged in the conventional manner. Air is now drawn through the converging mouth formed by the scoop 120 and the windrower W, which provide a preliminary acceleration of the airstream as it enters the tunnel T. The air stream, now at its lower velocity, is deflected 90° and then flows the full length of the front chamber FC. Due to the downwardly inclined top wall 82 of that chamber (FIG. 5) the stream of air entering by means of tunnel T is gradually or progressively accelerated, thereby increasing its velocity and hence its kinetic energy.

The hydraulic motor 146 for the broom or brush B will have been started and as the hood H advances along the swept surface, broom B dislodges caked dirt from the surface and as indicated in FIG. 4, propels it in a slightly upward direction beneath the lower end of the partition 92 and into the accelerating stream of air in the forward compartment FC. Thus, debris dislodged by the broom is entrained and carried along by the stream of air in the forward compartment. The stream of air is drawn into the suction line 42 and hence into the hopper by the blower B through its inlet ports 70,72 (FIG. 2), through the walls of the filters F, through the lower openings of the filters F, through the upper portion of the debris compartment 50, through the compartment duct 62 (FIG. 2A) and hence as mentioned, up through the suction line 42.

The heavier particles of debris settle out in the debris compartment 50 as indicated in FIG. 1 and the lighter particles collected by the filters F, are periodically shaken free by the shaking mechanism 58 and are dropped into the debris compartment 50.

If the swept surface is a road or street having a curb, such as the curb 124 shown in FIGS. 3 and 5, the operator of the sweeper steers the vehicle so that the outer (righthand in this embodiment) edge of the wall 122 of the scoop 120 is very close to or scrapes along the side wall of the curb. Thus the scoop picks up debris that might otherwise be left at the curb, since no curb brush is utilized. The flexible construction of the scoop 120 accommodates slight steering errors on the part of the operator in that if he brings the hood too close to the curb, the scoop will merely be deformed somewhat and will continue to provide its pickup function.

Thus the hood of the present invention provides no dust puffing problems because it is of the vacuum type, but due to the effective utilization of the kinetic energy of the long air stream in the front chamber FC, the energy required to operate the blower B is less than that of the conventional vacuum type sweeper. Also, the broom B need not be supplied with enough power to elevate the debris loosened from the swept surface but it only requires sufficient energy from the hydraulic motor that drives it to fling the dust forwardly beneath the partition 92 (FIG. 4) into the air stream in the forward compartment SC.

Although the best mode contemplated for carrying out the present invention has been herein shown and described, it will be apparent that modification and variation may be made without departing from what is regarded to be the subject matter of the invention as defined in the appended claims.

I claim:

1. In a street sweeper or the like of the type having a mobile chassis, a debris hopper, a blower having its inlet connected to the hopper for exhausting air from the hopper, an elongate transverse hood, a driven rotatable cylindrical broom in said hood, an air and debris inlet port for the hood and a suction line connecting said hood to the hopper; the improvement in said hood wherein said hood comprises a main compartment having a top wall, depending front, rear and end walls that make sealing engagement with the swept surface, said hood having an intermediate transverse partition depending from said top wall to divide said main compartment into elongate, parallel front and rear transverse compartments, said front compartment comprising a transverse air stream duct that is substantially unobstructed along its length, said air and debris inlet port being at one end of said duct, said suction line being connected to the other end of said duct for creating a uni-directional air stream along said duct, said broom being rotatably mounted in said rear compartment for dislodging debris from the swept surface and throwing it into said air stream, the lower edge of said partition stopping short of the swept surface for accommodating the generally horizontal passage of dislodged debris into the air stream, the top wall of said hood being imperforate along its length up to said suction line.

2. In a street sweeper or the like of the type having a mobile chassis, a debris hopper, a blower having its inlet connected to the hopper for exhausting air from the hopper, an elongate transverse hood, a driven rotatable cylindrical broom in said hood, an air and debris inlet port for the hood and a suction line connecting said hood to the hopper; the improvement in said hood wherein said hood comprises a main compartment having a top wall, depending front, rear and end walls that make sealing engagement with the swept surface, said hood having an intermediate transverse partition depending from said top wall to provide elongate, parallel front and rear transverse compartments, said front compartment comprising a transverse air stream duct that is substantially unobstructed along its length, said air inlet port being disposed at one end of said duct and opening forwardly, said suction line being connected to the other end of said duct for creating a uni-directional air stream along said duct, said broom being rotatably mounted in said rear compartment for dislodging debris from the swept surface and throwing it into said air stream, the lower edge of said partition stopping short of the swept surface for accommodating the generally horizontal passage of dislodged debris into the air stream, the top wall of said hood being imperforate along its length up to said suction line.

3. The sweeper of claim 2, comprising an angled debris deflector projecting forwardly and laterally from the downstream edge of said inlet port, said deflector being substantially coextensive with said hood.

4. The sweeper of claim 3, comprising an angled, inlet scoop projecting forwardly and laterally from the upstream edge of said inlet port, said scoop projecting laterally outwardly of the end wall of the hood at said inlet port for scooping up debris adjacent a curb or the like.

5. The sweeper of claim 4, wherein the lateral extent of said scoop is not substantially greater than that of said air inlet port.

6. The sweeper of claim 5, wherein said scoop has a resilient outer side wall portion that makes sealing engagement with the swept surface.

7. The sweeper of claim 6, wherein said scoop is formed of flexible material and has a flexible top wall portion that forms a portion of the upper boundary of said air inlet port.

8. In a street sweeper or the like of the type having a mobile chassis, a debris hopper, a blower having its inlet connected to the hopper for exhausting air from the hopper, an elongate transverse hood, a driven rotatable cylindrical broom in said hood, an air and debris inlet port for the hood and a suction line connecting said hood to the hopper; the improvement in said hood wherein said hood comprises a main compartment having a top wall, depending front, rear and end walls that make sealing engagement with the swept surface, said hood having an intermediate transverse partition depending from said top wall to divide said main compartment into elongate, parallel front and rear transverse compartments, said front compartment comprising a transverse air stream duct that is substantially unobstructed along its length, said air and debris inlet port comprising a forwardly opening tunnel disposed at one end of said duct, said suction line being connected to the other end of said duct for creating a uni-directional air stream along said duct, said broom being rotatably mounted in said rear compartment for dislodging debris from the swept surface and throwing it into said air stream, the lower edge of said partition stopping short of the swept surface for accommodating the generally horizontal passage of dislodged debris into the air stream, the top wall of said hood being imperforate along its length up to said suction line, said tunnel having an outer side wall that is an extension of the end wall of said hood at said inlet port, a top wall, and an inner side wall that projects from the upstream edge of said air inlet port, an angled debris deflector projecting from the end of said outer tunnel side wall and an angled flexible inlet scoop projecting from the end of said inner tunnel side wall and laterally outwardly of the end wall of said hood at said inlet port for scooping up debris adjacent a curb or the like.

9. The sweeper of claim 8, wherein the lateral extent of said scoop is not substantially greater than that of said air inlet port.

10. The sweeper of claim 8, wherein the lateral extent of said scoop is less than that of said air inlet port.

11. The sweeper of claim 8, wherein said scoop has a flexible outer side wall that makes sealing engagement with the swept surface.

* * * * *

UNITED STATES PATENT AND TRADEMARK OFFICE

CERTIFICATE OF CORRECTION

PATENT NO. : 4,110,864

DATED : September 5, 1978

INVENTOR(S) : Arne Nils Gunnarsson

It is certified that error appears in the above-identified patent and that said Letters Patent are hereby corrected as shown below:

Column 5, line 2, after "surface" insert a period; delete all after "surface" in line 2 and delete line 3 up through the word "brooms" in line 3 and substitute therefor -- Unless such brooms are sufficiently large and adequately powered, they --.

Column 14, line 39, delete "outer" and substitute therefor -- inner --.

Column 14, line 40, delete "inner" and substitute therefor -- outer --.

Figure 1, center, delete the lower of two item numbers "44" and substitute therefor -- 40 --.

Signed and Sealed this

*Twenty-second* Day of *May 1979*

[SEAL]

*Attest:*

RUTH C. MASON
*Attesting Officer*

DONALD W. BANNER
*Commissioner of Patents and Trademarks*

UNITED STATES PATENT AND TRADEMARK OFFICE

CERTIFICATE OF CORRECTION

PATENT NO. : 4,110,864

DATED : September 5, 1978

INVENTOR(S) : A. N. Gunnarsson

It is certified that error appears in the above-identified patent and that said Letters Patent are hereby corrected as shown below:

In column 5, lines 2 and 3, delete "but unless they are large and adequately powered, in prior sweepers such as brooms" and place a period (.) after the word surface in line 2. Substitute therefor -- Unless such brooms are sufficiently large and adequately powered they --.

Signed and Sealed this

*Eighteenth* Day of *September 1979*

[SEAL]

*Attest:*

*Attesting Officer*

LUTRELLE F. PARKER

*Acting Commissioner of Patents and Trademarks*